US006108992A

United States Patent [19]

Shaw

[11] Patent Number: 6,108,992

[45] Date of Patent: Aug. 29, 2000

[54] ROT PROTECTOR

[76] Inventor: John G. Shaw, PO Box 325, Cobourg, Ontario, Canada, K9A 4W5

[21] Appl. No.: 09/170,234

[22] Filed: Oct. 13, 1998

[51] Int. Cl.[7] ..... E04B 1/70

[52] U.S. Cl. ..... 52/302.3; 52/177; 52/650.3; 52/737.3

[58] Field of Search ..... 52/302.1, 177, 52/517, 650.3, 737.3, 302.3

[56] References Cited

U.S. PATENT DOCUMENTS

| | | | |
|---|---|---|---|
| 4,885,882 | 12/1989 | Forshee | 52/177 |
| 4,907,387 | 3/1990 | Turnbull | 52/177 |
| 5,613,339 | 3/1997 | Pollock | 52/731.1 |
| 5,794,390 | 8/1998 | Oliveri et al. | 52/177 |
| 5,875,604 | 3/1999 | Rudd | 52/731.8 |
| 5,904,011 | 5/1999 | Biro | 52/177 |
| 5,913,784 | 6/1999 | Hite | 52/177 |

*Primary Examiner*—Carl D. Friedman
*Assistant Examiner*—Yvonne M. Horton

[57] ABSTRACT

A wood rot protector for use between two intersecting portions of lumber, and having a protector for attachment over the upper edge of a lower portion of lumber, the protector having a web overlying the upper edge of the lumber, and in some cases having side walls, an upper surface of the web having a central planar median strip. In one embodiment the protector is in the form of a planar strip having angled side edges extending outwardly from the edges of the lumber to a width greater than the width of the lumber to carry moisture away from the lumber and allow it to drip downwardly. In another embodiment the protector may have side walls extending down partially over each side of the piece of lumber. Grooves may be formed on the upper surface of the median to prevent migration of moisture along the upper surface.

8 Claims, 5 Drawing Sheets

ROT PROTECTOR

FIELD OF THE INVENTION

The invention relates to a rot protector for use with joists, trusses, decks and any other wood structures liable to accumulate moisture, particularly, but not exclusively, where two portions of lumber overlie one another.

BACKGROUND OF THE INVENTION

Moisture accumulation on and around lumber is known to cause wood rot and the only cure is simply to replace the rotted wood with fresh wood. The problem is most acute in exterior wooden structures, in particular wooden decks, balconies, and other wooden structures which are erected out of doors and are exposed to frequent soaking moisture accumulations. Rain, snow melt, and simply humidity can all cause accumulations of moisture on and in such structures, leading to rotting of the wood. The problem is further added to by the lack of air circulation between the two portions of lumber where they intersect.

The problem can also occur however in interior wooden structures, particularly in roof joists and basement joists. The problem occurs most often where two portions of lumber are located and fastened across one another with one overlying and crossing the other, although any lumber exposed to moisture which does not readily run off will eventually rot.

Thus in exterior decks and balconies, and stairs or steps, joists are usually erected at appropriate spacings, typically about twelve to sixteen inches apart. Decking lumber is then nailed across the joists typically, although not exclusively, at right angles. The decking lumber is usually spaced apart by not more than one quarter of an inch. This allows rain and snow melt to drip down off the deck lumber through the gaps between adjacent portions of deck lumber and allows the surface of the deck lumber to dry out. However where the deck lumber intersects or crosses over the joists, moisture will inevitably penetrate between the deck lumber and the joists. This moisture is then trapped and cannot run off in the usual way. Further, due to the contact between the two portions of deck and joist lumber no air circulation can take place and this delays or entirely prevents the drying of the two portions of lumber at each intersection. The joist is then simply soaking up the moisture and this will cause rotting of the joist beneath the overlying deck lumber. In some cases the accumulation of moisture in these locations can also cause rotting of the underside of the deck lumber as well as rotting of the joists. Even where the two portions of lumber are closely bonded together, capillary action of moisture will cause moisture to seep in between them. This moisture is then trapped and remains there long after the upper or exposed surfaces of the lumber have dried out. The problem is somewhat aggravated by the nature of the nails fastening the deck lumber to the joists. When nails pass through the deck lumber and penetrate the top of the joists the nails cause depressions in the joists around the nails. Any moisture entering between the two portions of lumber of drawn in by capillary action is then trapped between the deck lumber and the joists will thus tend to collect in these depressions and will gradually seep down into the joists around the nails. The same moisture can be drawn upwardly into the underside of the deck lumber, again by capillary action similar to the action of a wick. The more the upper surface of the deck lumber dries out, the greater will be the wick action of the wood drawing the moisture upward.

This problem is aggravated by the area of contact between each portion of deck lumber and the underlying joists. Most deck lumber has a nominal width of four inches, and the joists, which are on edge, in most cases have a nominal width of two inches.

The area of contact at each crossing or intersection is thus nominally two inches by four inches making a total nominal contact area of eight square inches. This considerable area at each crossing thus provides a substantial area for accumulations of moisture, and also the prevention of air circulation.

The problem of moisture accumulation can also occur to a lesser extend on the upper edges of the joists where they are exposed in the gaps between the deck lumber. This is caused by the fact that it is desirable from the aspect of the users of the deck to place the portions of deck lumber as close as possible to one another, allowing only a minimum of spacing between the deck lumber portions for water drainage. Any noticeable spacing between the portions of deck lumber may damage shoes, and may permit small objects to fall through and be lost underneath the deck. The spacing is therefore minimised.

Run off moisture can accumulate on the small lengths of joists exposed between the portions of deck lumber, and due to the very small spacing, in most cases, it will eventually start to cause rot in these locations also. In addition moisture falling in these areas on the exposed lower timbers will tend to be drawn in under the adjacent overlying upper timbers a cause rot in these areas.

Clearly it is desirable to avoid the accumulations of moisture on the joists and under the deck lumber, and to provide a simple means for causing run off of rain and snow melt, in particular, from the deck, without accumulating on the joists. It is also advantageous if the contact area between the upper deck portions and lower joist portions of lumber can be reduced. This will reduce the area available for moisture accumulation, and thus reduce the quantity of moisture which can be trapped at any given location. This will greatly speed up the drying out process. Further it is desirable to provide for air circulation through the intersections so as to again speed up the drying out process. The same factors are true for many outdoor structures where lumber is exposed to weathering and moisture, and for certain indoor structures as well. It is also desirable to provide some means for preventing migration of moisture from the lower timbers where they are exposed to falling moisture back under the adjacent overlying timbers.

At first sight it would appear to be fairly straightforward to provide a cap of some moisture proof material to lay over the upper edges of the joists. In the past there has been a proposal to provide a solution to a somewhat related problem. For example U.S. Pat. No. 559,194, title Means For Protecting Foundation Timbers from Rot, issued in 1896, proposed dealing with a problem caused by moisture ascending up building foundation piles, due to capillary action, which would then damage the underside of the foundation timbers laid on top of the piles. This is the opposite of downward drainage.

The solution proposed was to provide metal caps which were to be nailed to the underside of the timbers. These caps would then overlie the tops of the building piles, and prevent moisture from ascending up the piles and rotting the foundation timbers by moisture entering from below. However this proposal did not deal with the problem of downward flow of moisture accumulating on the under surface of the lumber. In fact it increased this problem because the metal caps had to have an area greater than the area of the tops of the foundation pilot. This would then provide a greater area of moisture entrapment on the underside of the timbers or joists.

Thus while this proposal might have prevented upward flow of water around the foundation piles it did so at the expense of increasing the problems, described above, caused by downward flow of rain and snow melt which flows down between the deck lumber and accumulates on the upper surface of the joists and also seeps up into the underside of the deck lumber by capillary action within the wood fibres. Further it did nothing to provide for air flow around the timbers.

BRIEF SUMMARY OF THE INVENTION

With a view therefor to providing a solution caused by entrapment of moisture between two intersecting portions of lumber the invention provides, in one embodiment, a continuous rot protector for attachment over the upper edge of the lower portion of lumber, the rot protector having a web for overlying the upper edge of the lower portion of lumber, in which the web has an upper surface defining a central median strip which is substantially planar and parallel to the upper edge of the lumber, and having two side strips running along opposite side edges of the median strip, the side strips having upper surfaces being angled downwardly away from the plane of the median strip, wherein the median strip defines a contact area for contact with an overlying portion of lumber, and the two side strips defining wedge shaped spaces below such an overlying portion of lumber, the median strip preferably being narrower than the portion of lumber and thus substantially reducing the area of contact with the upper portion of lumber and permitting airflow to take place along the two side trips and the upper portion of lumber.

The invention further provides ridges formed along the underside of the web for contacting the upper edge of the portion of lumber, the ridges defining contact load bearing surfaces for transmitting the load of the upper portion of lumber to the upper edge of the lower portion of lumber, whilst at the same time defining air flow passages between the ridges to permit air flow along the upper edges of the lower portion of lumber.

The protector is of resilient thermoplastic material so that it can make a snug friction fit over the upper edge of the portion of lumber. Preferably it is formed by extrusion techniques so that the protectors can be made in extended lengths, at low cost. This enables the end user to purchase sufficient lengths of the protectors to extend along and cover the entire upper edges of all the lower portions of lumber, at minimum cost.

In one form the protector will have side walls be formed with a rib on each side. The ribs may have a pointed or hook shape so as to partially bite into the sides of the lumber. In this form the side walls of the protector have drip edges which are spaced away from contact with the wood thereby causing moisture running down the exterior of the side walls to drip off the side walls clear of the sides of the lumber.

In another form the inner surface of the web of the protector would simply be formed with parallel grooves, defining load bearing surfaces between the grooves.

In another form the ridges on the inner surface would raise the entire inner surface off the edge of the lumber, and side strips would be formed with inner angled surfaces which would be spaced from the edge of the lumber and would not be bearing any load.

In a simplified embodiment of the invention the rot protector make take the form of a generally planar strip, having upper and under sides, the upper side having a median load bearing surface parallel with the plane of the upper surface of the joist, and having two side edge strips angled downwardly away from the median strip, for shedding water outwardly, and the underside of the strip would have a generally planar load bearing surface for transferring the deck load to the joist, and there would be a plurality of air flow grooves formed either in the planar load bearing surface, or between load bearing ridges, to allow air circulation along the upper surface of the edge of the joist. In this embodiment there would be no protector side walls as such, but instead given a joist of a predetermined width, say nominally two inches, usually meaning about one and seven eighths inches in fact, the side edges of the joist protector would extend outwardly of the joist to a width, greater than the actual width of the joist, so as to provide for a drip edge outwardly of the side surfaces of the joist, allowing moisture to drip down without penetrating the joist side surfaces.

In another form the rot protector will have transverse grooves formed on its upper load bearing surface. These transverse grooves both increase air circulation beneath the upper pieces of lumber, and also prevent migration of moisture falling on the lower pieces of lumber in the spaces between the upper pieces of lumber which might otherwise enter into the joint areas between the lower and upper pieces of lumber.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
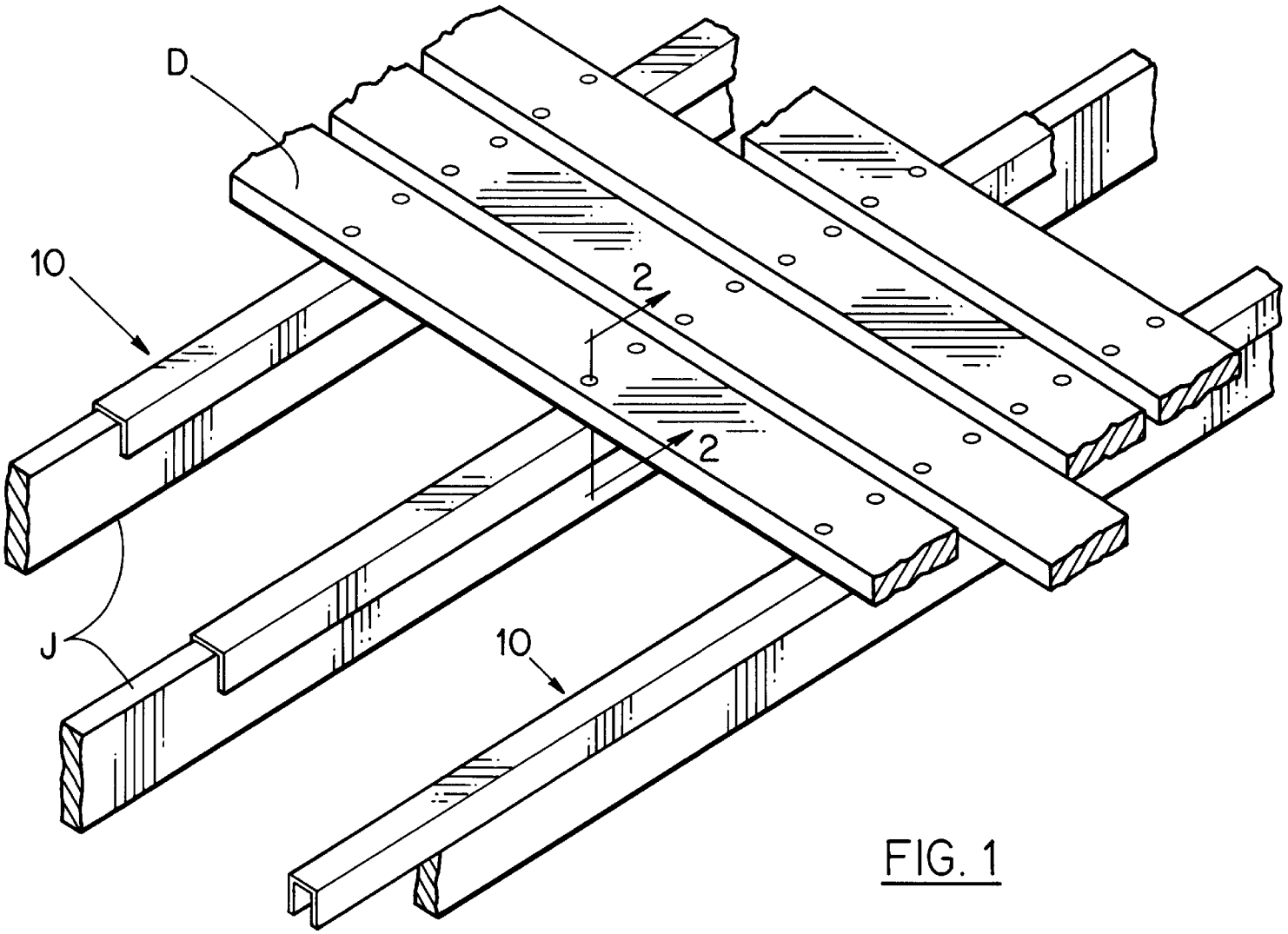
FIG. 1 is a perspective of a typical deck or exterior wood structure, partially cut away to show the channels illustrating the invention on the upper edges of lumber in this case, joists.
Figure 2:
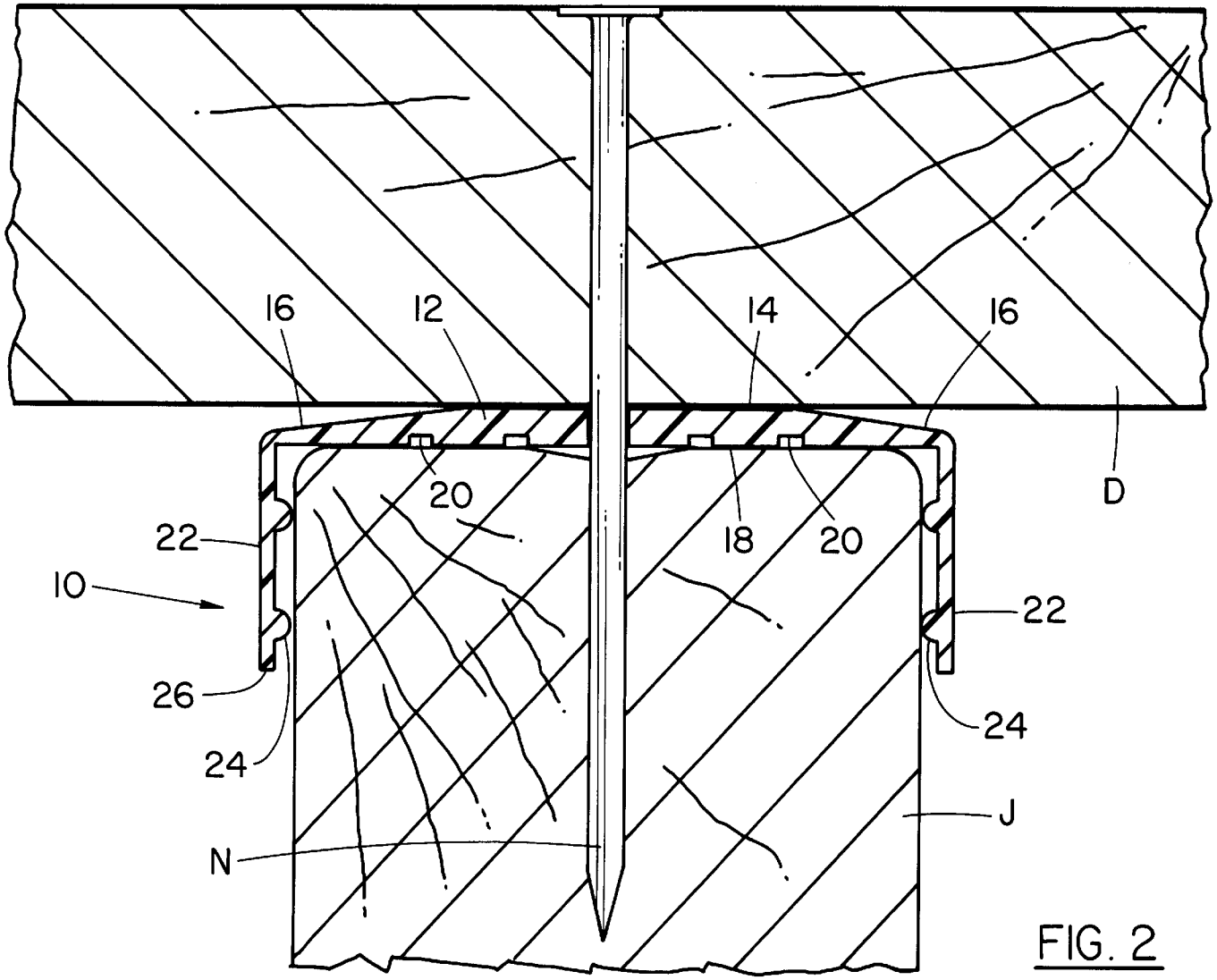
FIG. 2 is a section along line 2—2 of FIG. 1.
Figure 3:
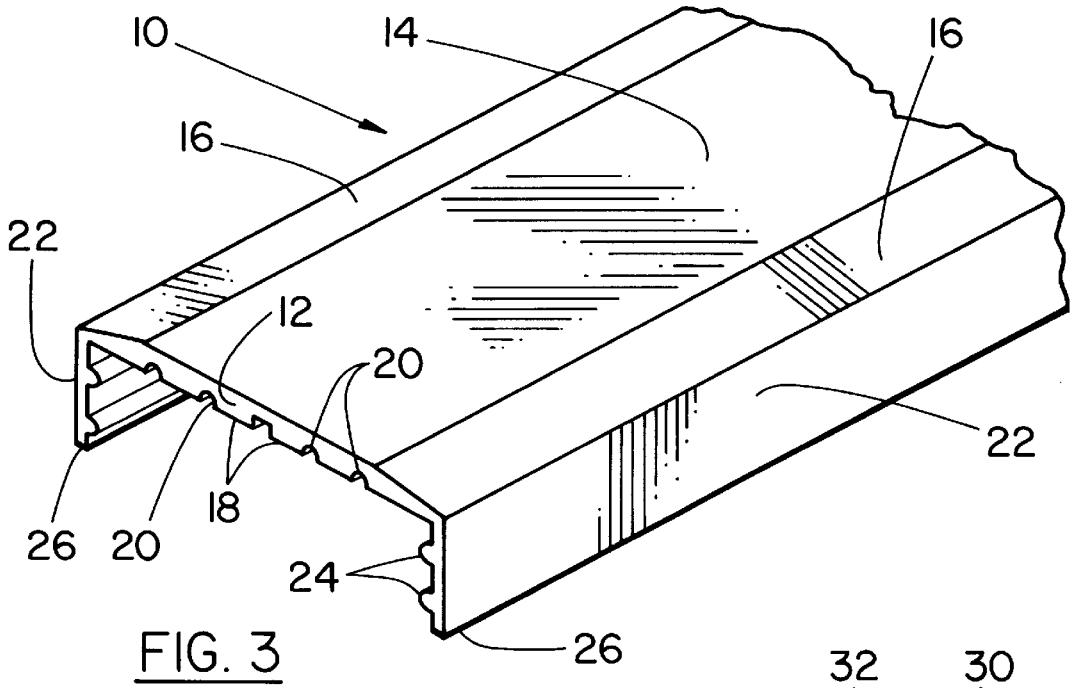
FIG. 3 is a perspective of a channel illustrating one form of the invention.

Referring to FIGS. 1, 2 and 3, it will be seen that the invention is there illustrated in use in a typical outdoor wood structure, in this case a wooden deck indicated generally a D. Typically such structures will have lower portions of lumber known as joists and indicated as J, set on edge to support the load on the deck. The joists will, in most cases be supported at each end, and possibly at intervening locations, by vertical supports, or in some cases foundations, (not shown). However in many cases such decks are simply formed by outward extensions of joists located within a home or building, in which case they may be simply cantilevered, and a free of any support at their outboard ends. All of this is very well known, but is repeated here so as to give the fullest appreciation of the advantages of the invention.

On the joists the actual decking lumber indicated as D is laid crosswise and is typically secured to the joists by nails N (FIG. 2). The decking L is usually although by no means always at right angles to the joists. Consequently where each portion of decking intersects a joist there exists an area of close contact which is a simple multiple of the joist thickness and the decking width. The joists typically having a nominal two inch thickness are used in conjunction with decking typically being of two by four lumber, although in some cases it may be two by six. Thus the contact area at each intersection will thus be eight square inches, nominal, or even twelve square inches nominal. This provides a substantial area, at each intersection, where moisture can collect and where there is no air circulation either around the upper edge of the joist, or around the underside of the decking.

It is well known that such contact areas lead to rotting of the joists and also of the decking, due to moisture which is collected and trapped and due to lack of air circulation.

This can cause a deck to rot and require complete replacement at intervals in the life of a house or other building. This may be accepted in many cases simply as a cost of upkeep, but clearly users would prefer not to have this burden. However in the case of cantilever decks the problem is much more serious. The joists supporting a cantilever deck are simply extensions of floor joist from the interior of a building. Once those cantilever joists start to rot, the deck is totally unsupported and is unusable. However, in addition to this the rot will usually travel along the joists back into the interior of a house, and endanger the entire floor structure of what appears to be an otherwise sound building. Purchasers of this type of building, usually vacation homes, often do not realise the hazards of such cantilevered decks. Usually they purchase the vacation homes as a package from a manufacturer, and the problem does not appear until they attempt to sell the building, which may be ten or twenty years later. The new purchaser may have the structure inspected and it is only then that the seriousness of the problem becomes evident.

Clearly therefore there is a serious problem of wood rot with exterior wood structures of this type. The problem may also arise in interior joists and flooring, or for that matter roofing, especially in damp or semi tropical climates.

In accordance with the invention there is provide a rot protector which separates the two portions of lumber, typically the joists from the deck, and which prevents moisture accumulation on the joists. The protector also reduces the contact area on the underside of the decking thereby reducing the area for moisture wicking upwards into the deck. This promotes free air circulation around a greater area of the underside of the deck, leading to faster drying of the underside of the deck.

As illustrated in FIGS. 1, 2, and 3, the rot protector is there illustrated in the form of a protector indicated generally as 10. The protector has a web 12 defining a median planar load bearing strip 14 and side strips 16—16 along either side of the median strip. The median strip defines an upper surface which is parallel to the plane of the upper edge of the joist and is designed to contact the underside of the deck and transfer the load of the deck to the joist. It is narrower than the width of the joist and hence forms a smaller contact area with the underside of the deck.

The side strips 16—16 are formed with upper surfaces which are angled downwardly away form the median strip 14 and hence carry moisture away readily allowing it to flow off the upper surface of the web away from the joist.

On the underside of the web there are formed load bearing ridges 18—18. Although there are only two such ridges shown, it is understood that this number is without limiting the scope of the invention. The ridges may be formed as generally rectangular shaped protrusion from web 12 or, as is shown below, may be defined simply by grooves in the underside of the web. The term "ridge" as used herein is deemed to be generic to all such formations and is without limitation.

The ridges 18—18 contact the upper surface of the edges of joist J and transfer the load of the deck to such joists. Between such ridges there are defined air circulation grooves 20—20 for permitting air circulation along the interior of web 12 between itself and joist J.

On either side of the web 12, in this embodiment, there are integrally formed protector side walls 22—22. As mentioned the rot protector in this embodiment is preferably formed by plastics extrusion techniques in which the entire structure of web and side walls are all formed as a continuous integral element, which is simply cut off in convenient lengths suitable for shipping and for display in retail stores and lumber yards. Consequently, as illustrated the side walls 22—22 are integral with the web, in this embodiment, although conceivably other forms of fabrication might be used in some cases. However the invention is not restricted solely to the integral form of fabrication as shown but is deemed to include any form of fabrication producing the inventive advantages.

Figure 4:
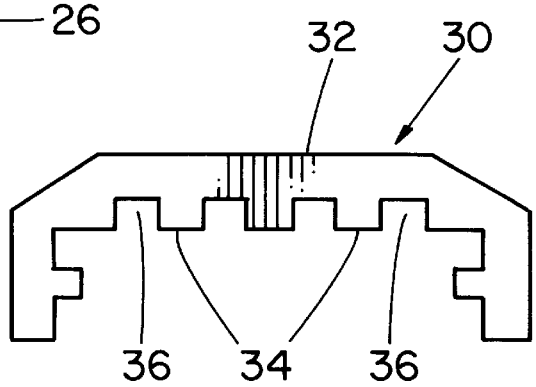
FIG. 4 is a section of another form of channel.

FIG. 4 shows a modification in which the protector 30 has a web 32 formed with a planar load bearing surface 34 having air grooves 36 formed in it.

Figure 5:
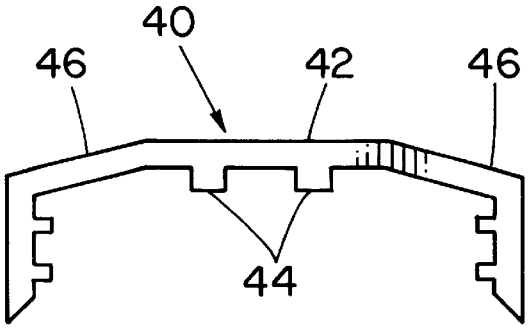
FIG. 5 is a section of another form of channel.

FIG. 5 shows a modification in which the protector 40 has a median strip 42 supported by ridges 44, of somewhat greater depth than in the FIG. 1 embodiment, raising the entire web higher off the joist. The side strips 46 are formed as downwardly angled strips, located spaced above the surface of the joist, which would in fact define a greater air circulation space over the top of the joist.

Figure 6:
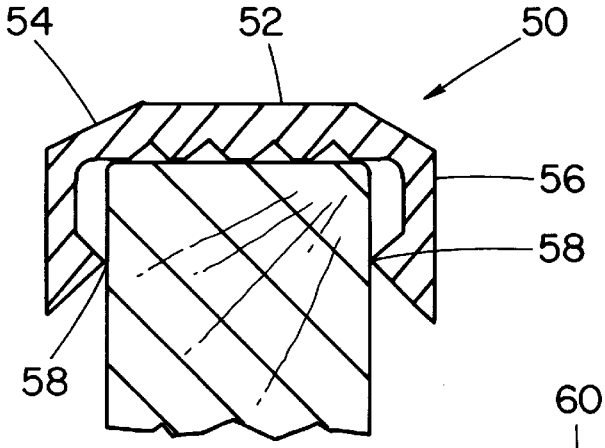
FIG. 6 is a section of another form of channel.

FIG. 6 shows a modification in which the protector 50 has a web 52 with side strips 54. The side walls 56 are formed with sharp pointed ribs 56 to bite into the sides of the joist and hold the protector firmly in place.

Figure 7:
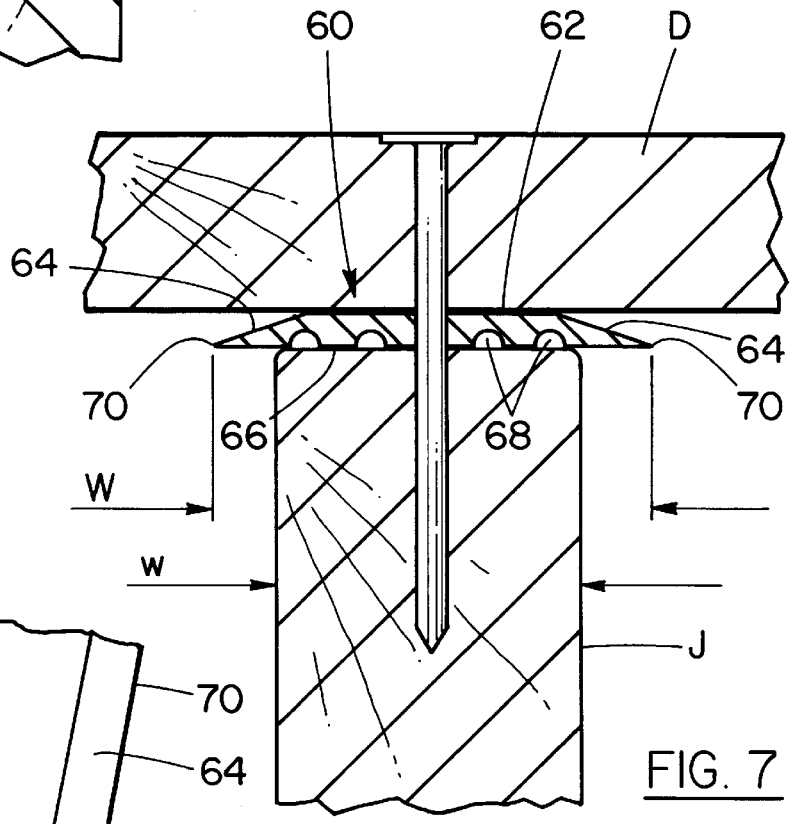
FIG. 7 is a section of another form of rot protector.
Figure 8:
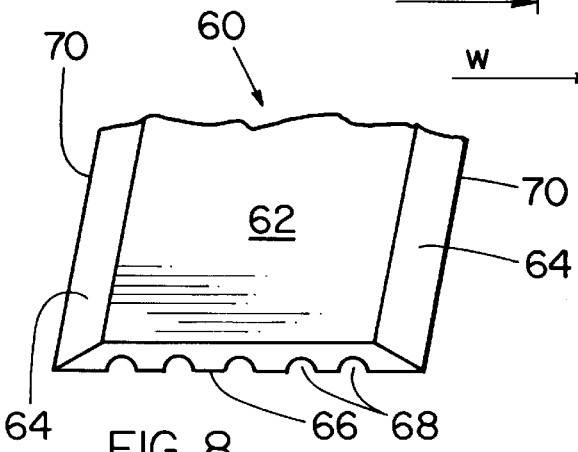
FIG. 8 is a cut away perspective of the FIG. 7 embodiment.

FIGS. 7 and 8 show another embodiment which might serve adequately in some cases. In this case the protector 60 is formed with a load bearing median strip 62 and angled side strips 64 on each side, as before. The under surface of the web is designed to transfer load to the joists, and may be formed with planar load bearing surfaces 66, as in the FIG. 4 embodiment, with air grooves 68 formed therein. Although not shown it will be understood that it could equally will be formed with load bearing ridges, as in the FIG. 2 embodiment.

However in this embodiment there are no protector side walls as such. Instead the side strips 64 are extended outwardly to form drip edges 70. These are spaced outwardly from the width of the joist. In this way water will run down the angled surfaces of the side strips 64 and drip down of the drip edges 70, falling clear of the sides of the joist. Thus where the joist has a predetermined width w, the drip edges define a width W greater than w. Preferably this excess is in the region of 10% to 20% greater to ensure water dripping clear of the joist.

Figure 9:
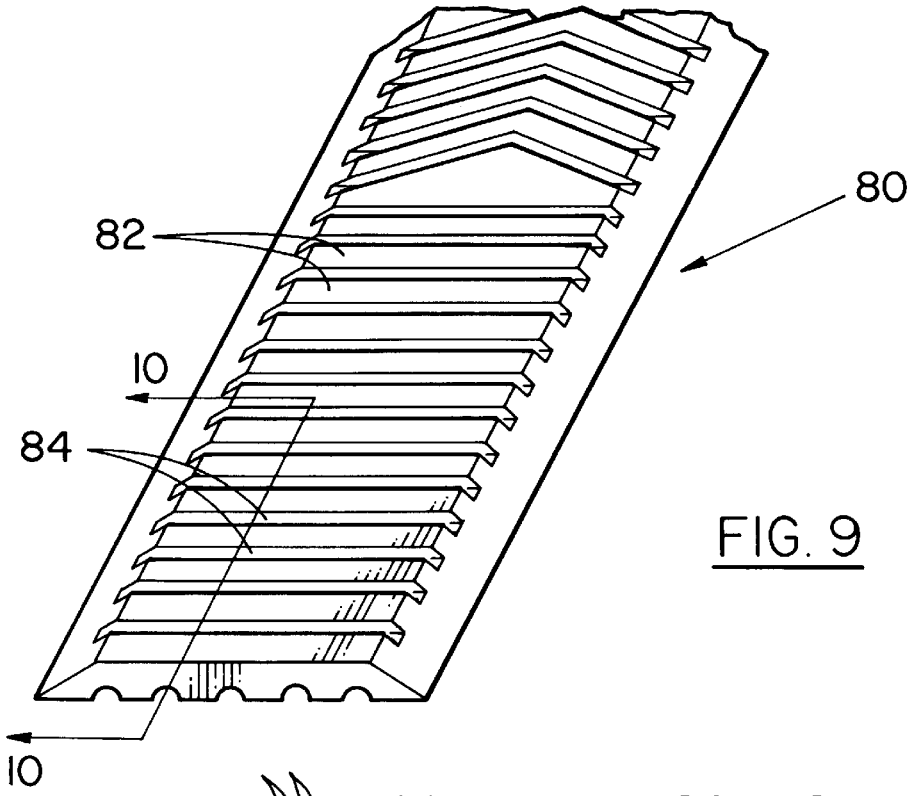
FIG. 9 is a perspective of another embodiment of rot protector having transverse grooves in its upper load bearing surface, and, FIG. 10 is a section along line 10—10 of FIG. 9.
Figure 10:
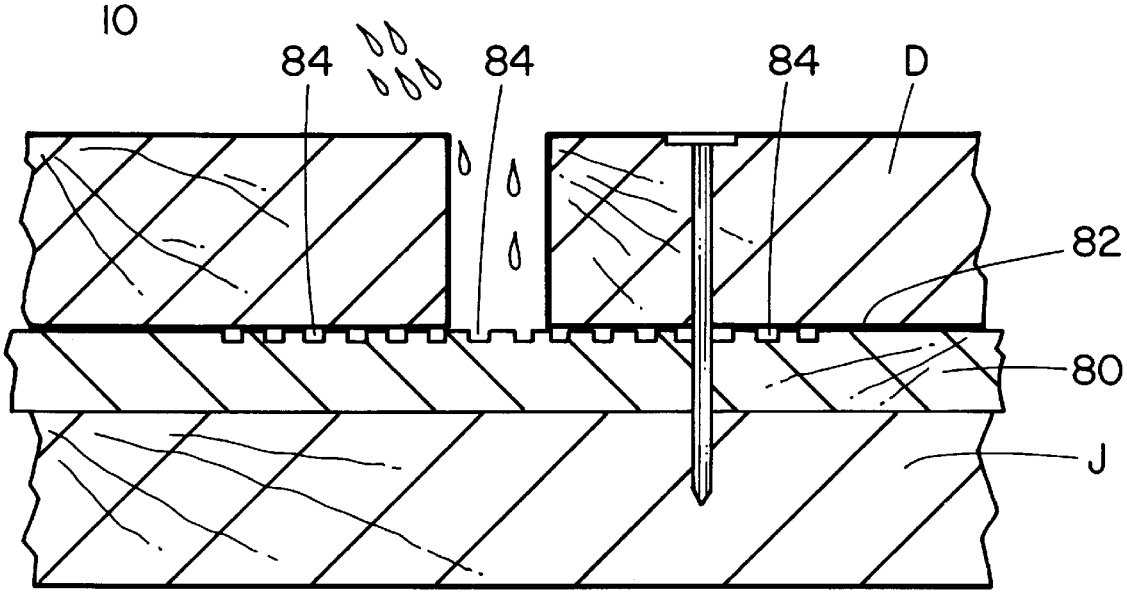

FIGS. 9 and 10 illustrate a still further modification that may be advantageous. In this form the rot protector 80 is illustrated as having a form generally similar to that of FIGS. 7 and 8. However in this case the upper load bearing surface 82 has transverse grooves 84 formed therein. These grooves may be parallel, or may be chevron shaped or diagonal, and may have a cross section which is U shaped or V shaped or any other shape which is easily formed during the extrusion process. Preferably it will be formed with divergent side walls so as to be easily indented in the hot plastic exiting from the extrusion die. The grooves may be shallow, or even absent, at the center of the median area of the upper surface, and may become progressively deeper as they extend outwardly towards the edges of the median, so as to create a watershed effect. These grooves will both increase air circulation to the underside of the upper piece of lumber, and will also prevent migration of moisture along the upper surface of the lower piece of lumber.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A wood rot preventor adapted for use between two intersecting portions of lumber, namely an upper portion of lumber and a lower portion of lumber, said lower portion defining an upper edge and a lower edge, and said upper portions of lumber defining a predetermined load and said load being transmitted to said lower portions of lumber, and comprising:

a elongated protector adapted for attachment over the upper edge of a lower portion of lumber, the protector in turn comprising, a web for overlying the upper edge of the lower portion of lumber;

side walls for extending partially downward from said web along either side of the lower portion of lumber;

an upper surface of said web defining a central median strip which is substantially planar and parallel to the upper edge of the lower portion of lumber, and, two side strips running along opposite side edges of said central median strip, said side strips having upper surfaces angled downwardly away from the plane of said median strip, wherein said median strip defines a planar contact area for contact with an upper portion of lumber, and said two side strips define wedge shaped spaces below such an upper portion of lumber, said median strip being narrower than said lower portion of lumber and thus substantially reducing the area of contact with said upper portion of lumber and permitting airflow to take place along said two side strips and said upper portion of lumber;

said side walls defining inner surfaces adapted to overlie the sides of said lower portion of lumber;

ribs formed along the inner surfaces of said protector side walls for contacting the sides of said lower portion of lumber and for maintaining the remainder of said inner surfaces of said protector side walls out of contact with said lower portion of lumber whereby to permit air circulation between the inner surfaces of said protector side walls and the sides of said lower portion of lumber.

2. A wood rot preventer as claimed in claim 1 and including ridges formed along the underside of the web for contacting the upper edge of the lower portion of lumber, the ridges defining planar contact load bearing surfaces for transmitting the load of the upper portion of lumber to the upper edge of the lower portion of lumber, whilst at the same time defining air flow passages between the ridges to permit air flow along the upper edge of the lower portion of lumber.

3. A wood rot preventer as claimed in claim 2 wherein said protector is formed of resilient thermoplastic material and is dimensioned whereby said ribs on said side walls make a snug friction fit over the sides of the lower portion of lumber.

4. A wood rot preventer as claimed in claim 3 wherein said protector is formed by extrusion techniques so that said protectors can be made in extended lengths, at low cost.

5. A wood rot preventer as claimed in claim 1 wherein said protector side walls are formed with a single rib on each side, the ribs having a pointed or hook shape so as to partially bite into the sides of the lumber.

6. A wood rot preventer as claimed in claim 5 wherein said side walls have drip edges which are spaced away from contact with the wood thereby causing moisture running down the exterior of the side walls to drip off the side walls clear of the sides of the lumber.

7. A wood rot preventer as claimed in claim 1 wherein the web of the protector is formed with parallel grooves, defining load bearing surfaces between the grooves.

8. A wood rot preventer adapted for use between two intersecting portions of lumber, namely an upper portion of lumber and a lower portion of lumber, said lower portion defining an upper edge and a lower edge, and said upper portions of lumber defining a predetermined load and said load being transmitted to said lower portions of lumber, and comprising;

a elongated protector adapted for attachment over the upper edge of a lower portion of lumber, the protector in turn comprising, a web for overlying the upper edge of the lower portion of lumber;

side walls for extending partially downward from said web along either side of the lower portion of lumber;

an upper surface of said web defining a central median upper surface strip which is substantially planar and parallel to the upper edge of the lower portion of lumber, and, two upper surface side strips running along opposite side edges of said central median strip, said side strips having side strip surfaces angled downwardly away from the plane of said median strip, wherein said median strip defines a planar contact area for contact with an upper portion of lumber, and said two side strips define wedge shaped spaces below such an upper portion of lumber, said median strip being narrower than said lower portion of lumber and thus substantially reducing the area of contact with said upper portion of lumber and permitting airflow to take place along said two side strips and said upper portion of lumber.

* * * * *